United States Patent [19]

David

[11] Patent Number: 4,669,727

[45] Date of Patent: Jun. 2, 1987

[54] DOUBLE-BAR RIDING WHEEL AND METHOD OF USING SAME

[76] Inventor: Constant V. David, 4952 Field St., San Diego, Calif. 92110

[21] Appl. No.: 772,050

[22] Filed: Sep. 3, 1985

[51] Int. Cl.[4] ..... A63B 67/14

[52] U.S. Cl. ..... 273/110; 273/128 A; 446/170; 446/447

[58] Field of Search ..... 273/109, 110, 118, 120 R; 446/170, 447

[56] References Cited

U.S. PATENT DOCUMENTS

| | | | |
|---|---|---|---|
| 145,385 | 12/1873 | Bean | 273/120 R |
| 570,105 | 10/1896 | Ryan et al. | 273/110 |
| 973,935 | 10/1910 | George | 273/109 |
| 2,886,323 | 5/1959 | Irwin | 273/109 |
| 3,985,360 | 10/1976 | Meyer | 273/120 R |
| 4,561,656 | 12/1985 | David | 273/110 |

FOREIGN PATENT DOCUMENTS

| | | | |
|---|---|---|---|
| 842735 | 6/1939 | France | 273/109 |

OTHER PUBLICATIONS

Hong Kong Toy, 1977 Magazine Photograph Title "Magic Running Wheel".

*Primary Examiner*—Richard C. Pinkham
*Assistant Examiner*—Gary Jackson

[57] ABSTRACT

A double-bar riding wheel positioned between two circular cross-section bars acting as support. One end of each bar is partly restrained but permits a limited amount of rotational movement of the bar. The other end of each bar is held by an operator's hand by means of a handle, thus providing the wheel actuating motion by lifting the handles. The bar cross-sections generally increase from one end to the other. The riding wheel is equipped with two shafts, one attached to each one of the two sides of the wheel. The combination of the variations of the bar shapes lengthwise and of the shaft shapes lengthwise makes it difficult for the wheel to remain astride of the two bars while being urged to ride forward by the operator. The shapes of both shafts and bars are such that the degree of difficulty increases from one end of the bars to the other. The object of the operation, is to make the wheel ride the full length of the bars, or at least to proceed as far as possible from the starting point. The movements of the handles are automatically limited so that only one shaft may fall off its rolling position on top of a bar, thus stopping the wheel riding. The wheel is prevented from ever falling between the two bars. Indicia on the bars are used to record the location where the wheel then stops. Various coordinated motions of both hands are needed to control and steer a successful wheel ride, which requires manual skill and dexterity from the operator.

22 Claims, 17 Drawing Figures

DOUBLE-BAR RIDING WHEEL AND METHOD OF USING SAME

BACKGROUND OF THE INVENTION

The present invention relates to a game of skill in dynamics and involves the use of three basic movements of both hands of an operator: vertical, lateral and rotational; and their coordination between the two hands. The skill and dexterity of the operator are rendered measurable. The game and the apparatus used to play the game may also be utilized to help operators develop and improve their manual skill and dexterity.

Many games based on the use of manual dexterity have been developed in the past. They most often involve the use of only one hand, seldom two concurrently. Usually, the apparatus conceived for playing the game does not provide the gradual transitional phase between on and off, with the feedback needed to exercize control, while the operator attempts to correct for the failing that he can see developing. Seldom do such games and apparatus provide a simple, automatic, visual and permanent record of the degree of skill then achieved by the operator.

Efforts are continuously being made to develop new games and toys which provide opportunities for persons of various ages to measure and gradually improve their manual dexterity. For example, it is desirable for the operator to be able to increase the level of the difficulties to be overcome in order to succeed as he becomes more proficient. Also, it is desirable to enable the the operator to alter the degree of difficulty built in the apparatus to match the stage of manual skill development that he has presently reached or will reach in the future with practice.

In view of this background, the present invention provides those features which skill games require and offers improvements in ways to develop and measure the degree of manual skill and dexterity which demand the coordination of both hands.

SUMMARY OF THE INVENTION

It is therefore a primary object of the present invention to provide a new and improved apparatus and method of use which requires the combined and coordinated use of both hands, said use involving simultaneously hand, wrist and arm motions.

It is another object of the present invention to provide an apparatus which can be used by people of all ages, requires little effort and measures both manual skill and dexterity.

It is still another object of the present invention to provide an amusement apparatus which can be changed and adjusted to vary the degree of difficulty of its operation to match the degree of proficiency of the operator.

It is still another object of the present invention to provide an amusement apparatus which is simple and safe to operate so that its operation presents no risk and/or danger either to the operator or the observers.

It is still another object of the present invention to provide an amusement apparatus that enables the operator and/or boservers to witness, measure and record the degree of skill demonstrated by the operator.

It is finally another object of the present invention to provide an apparatus which enables the operator to develop and improve his (her) manual skill and dexterity in coordinating and controlling the three basic types of movements of each hand and also of both hands simultaneously.

Accordingly, the present invention provides an apparatus that is simple, easy and safe to operate apparatus, which can be used by inexperienced and very expert operators alike with equal satisfaction, from the use of which all can benefit.

DETAILED DESCRIPTION OF THE INVENTION

Figures 1, 2, 3, 4, 5, 6, 7, 8, 9, 10, 11, 12, 13, 14, 15, 16, 17:
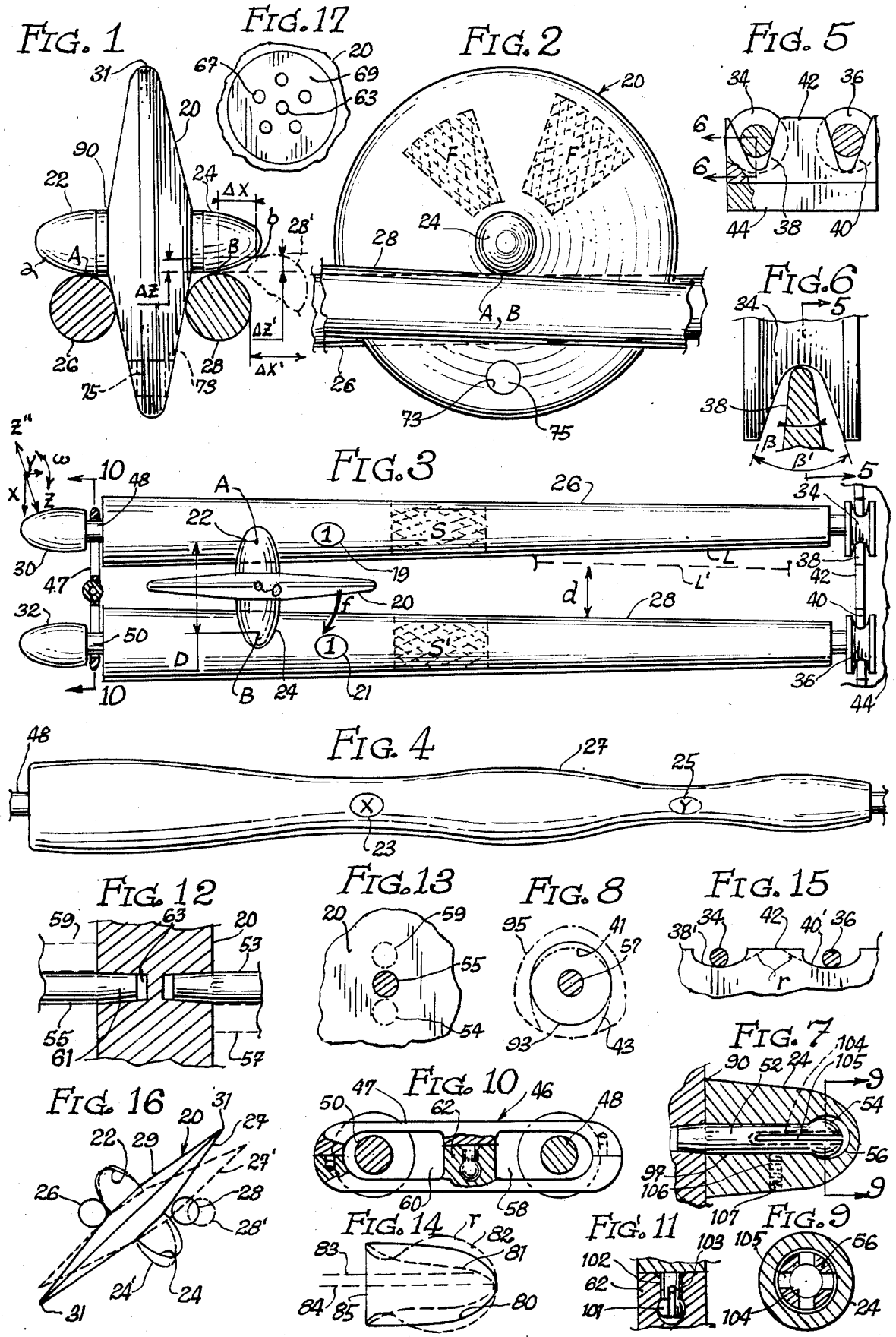
FIG. 1 is a midsectional side view of the wheel assembly taken along section line 1—1 of FIG. 2.
FIG. 2 is an elevation view of the wheel assembly shown riding two bars in non-parallel position.
FIG. 3 is a plan view of the wheel assembly shown riding both bars, in a correct straddling position.
FIG. 4 is an elevation view of another configuration of one of the riding bars.
FIG. 5 is a partial sectional view taken along section line 8—8 of FIG. 6.
FIG. 6 is a partial sectional elevation view taken along section line 6—6 of FIG. 5.
FIG. 7 is a partial sectional view of one shaft of the wheel assembly.
FIG. 8 is an end view of one shaft of the wheel assembly showing various possible shaft shapes.
FIG. 9 is a cross-sectional view of a typical mode of attachment of the shaft onto the wheel assembly.
FIG. 10 is an elevation view of the loop structure connecting the ends of the two bars.
FIG. 11 is a detail sectional view of the locking mechanism of the structural loop.
FIG. 12 is a partial side view of various axle mounting position possibilities.
FIG. 13 is a partial end view of various axle positions.
FIG. 14 is a schematical illustration of possible profile shapes of the shafts.
FIG. 15 is an end view of a semi-restraining arrangement of the supported ends of the bars.
FIG. 16 is a schematic illustration of the manner in which the wheel asembly is prevented from falling between the bars.
FIG. 17 is a partial view of one face of the wheel showing six possible locations of an axle shank into the wheel.

Referring to FIGS. 1 to 3, the preferred embodiment of the present invention is illustrated. A single-flange circular wheel 20 is equipped with two shafts 22 and 24, one on each face of the flange. Each shaft rests on a bar, 26 and 28, having a quasi circular cross-section and a quasi straight centerline. Each bar is equipped at one end with a handle, 30 and 32, for manipulation by the operator. At the other end, both bars have a circular spoolshaped body exhibiting grooves 34 and 36. These grooves rest on and are axially and laterally restrained by edges 38 and 40 that are part of supporting structure 42 mounted on support plate 44 that can be affixed to the edge of a table or of a desk (not shown). The handle end of each bar is laterally restrained by a structural loop 46 which connects trunnions 48 and 50 of the bars.

Lengthwise, bars 26 and 28 have variable cross-sections that vary gradually, but not necessarily uniformly. This is depicted in FIG. 4, in which the bar cross-section is shown typically swelling and shrinking thrice and twice respectively, between the ends of the bar.

Such swelling and/or shrinking cross-sections are not necessarily concentric, but can also be off-centered, one with respect to its neighbor. The bars of FIG. 3 show external surfaces that are free of such wave-like variations in shape.

Referring now to FIGS. 5 and 6, details of the rotatable articulation of one end of the bars show how the groove bottoms fit into the V-shaped recesses formed by the edges 38 and 40. The shapes of the edges and grooves are such that the bars are enabled bled to oscillate a total angle ($\beta-\beta'$), which is more than adequate for operating the apparatus. FIGS. 7 and 8 indicate how the shafts are positioned onto the wheel. An axle 52 is mounted on the side of the wheel. Shaft 24 is free to rotate on axle 52. The end of axle 52 has a deformable gland 54 that fits in cavity 56 so as to lock shaft 24 on axle 52, while enabling the operator to pull shaft 24 out (or push it in, as the case may be) if another shaft shape is desired. The gland section of FIG. 8 is an illustration of a typical way of how the external surface of gland 54 can be rendered deformable and made to assume a locking function also.

Referring now to FIGS. 10 and 11, details of the structural loop are shown and represent a typical embodiment. Loop 46 consists of a structure 47 which surrounds two openings 58 and 60 which encircle trunnions 48 and 50. The loop is restrained sideways by the end faces of the handles and of the bars. Openings 58 and 60 determine the amount of lateral displacements that the operator can impose on the handles, relatively to each other, without affecting their other movements within the limited range of relative lateral displacement just mentioned. Loop 46 consists of two halves which can easily be assembled or disassembled, as required, to "hand-cuff" the ends of the bars or to free them. At both of their ends, the two half loops have positioning pins and cooperating holes. A center supporting structure 62 is used to join the two loop halves and lock them in place. The details of this locking device is shown in FIG. 11. It is a deformable gland and holding cavity arrangement similar to that which is used to lock the shafts on their axles, but with a tighter fit.

Referring to FIGS. 12 and 13, variations in the mounting of the shaft axles are depicted. In the most ordinary case, both axles 53 and 55 share a common axis and are perpendicular to the plane of symmetry of wheel 20. However, axles 53 and 55 may be off-centered to assume the positions shown by phantom lines 57 and 59 respectively. Such off-centered positioning of the axles imposes on the wheel a wobbling and unsettling motion as it rotates around said axles.

FIG. 14 presents three different shapes of the external contours of the shafts. Such contours may or may not be off-centered with respect to their axle journals. They may be of revolution or shaped as the phantom line contours of FIG. 8 indicate. Also, when oppositely positioned and if the shafts have the same shapes, they may not be "in phase", in other words, if the shaft contours are not of revolution. Their lobes, such as 41 and 43 of one shaft, FIG. 8, may not angularly correspond locationwise, with lobes such as 41' and 43' (not shown) of the other shaft. Also, the shafts may rotate freely around their axles (relative angular position of the shafts left to chance) or be firmly attached to them (fixed relative angular position). Also, shafts of different shapes may be mounted on each face of the wheel.

FIG. 15 illustrates how another variation of the degree of lateral restraint of the constrained ends of the bars can be introduced by widening the width of the sharp edge recess holding the bar constrained end. Groves 34 and 36 rest in elongated recesses 38' and 40'. In this recess design, the end of the bar is forced to move vertically as it moves laterally. In FIG. 15, the recess profile is shown elliptically shaped, as an example. In all combinations of bar shapes, recess shapes, shaft shapes, etc. . . . , the dimensioning of these shapes is such that, for the combination providing the widest gap, at any location, between the bars, will not allow the wheel assembly to fall between the bars, for the worst case of positioning of the shafts onto the wheel, when one shaft slides off its bar.

Referring now to FIG. 16, wheel assembly 20 is shown in a position, with respect to the two bars, such that one shaft (24) has slid off bar 28. Face 27 of wheel 20 comes to rest on bar 28 and opposite bar 26 nestles in the corner made by shaft 22 and face 29 surfaces. The outer diameter of the wheel is always large enough to prevent ridge 31 from clearing bar 28, which would have to occupy position 28' to allow such a possibility. Loop 46 is used to eliminate such a possibility, as earlier mentioned.

FIG. 17 indicates how the axles may be located in and connected to the wheel. Six holes are shown on one face of the wheel. Six similar holes are also present on the other face. The five peripherally located holes on one face may or may not be located opposite to the other holes on the other face. Also, the number of peripherally located holes on one face does not necessarily correspond to the number of holes on the other face. In this configuration, the axles have a slightly conical shank 61 (FIG. 12) which engages a matching conical hole 63 in the wheel. Shaded area 69 indicates the contact surface between the wheel face and the corresponding shaft.

DISCUSSION AND OPERATION

The operation of the apparatus embodiment earlier described is based on the fact that the center of gravity (CG) of the wheel assembly constantly strives to lower itself. When both shafts are supported by the bars, the shafts will roll on the bars to reach any bar-shaft relative positions which cause the CG to be at its lowest point, if the bars are not moved. When such a stable equilibrium is reached, the wheel assembly stops, unless carried past that point because of momentum. However, a change in position of one or two bars normally disturbs this equilibrium, and the wheel CG is usually given an opportunity to seek another lower point of equilibrium. As easily understood from the description, several factors enter into causing such a disturbance. The number of possible combinations of these factors is large, some results are unpredictable and correcting their effects demands a thorough understanding of the wheel dynamic behavior and quick reflexes.

In its simplest configuration (FIGS. 1-3), the wheel assembly is supported by the bars at points A and B. In FIG. 1, the wheel is shown being tightly restrained laterally (wheel locked in place). Moving the bars up or down will not cause the wheel to rotate. However, in FIG. 3, the bars are shown separated to their maximum distance. Contact points A and B have moved outwardly to a region on the shaft contours where the shapes of the ends of the shafts are of prime importance. Points A and B have then assumed the positions shown by a and b, and the distance a-b is large enough to let one shaft slide off its bar if, inadvertently, the wheel assembly is caused to move sideways. If and when this happens, the ride is over. Wheel 20 takes an askance attitude as shown in FIG. 16, and the wheel is completely stopped.

If no precautions were taken, and the reflexes of the operator cannot be trusted to ever be fast enough, the wheel assembly could fall between the two bars and hit the ground, which might be undesirable. To prevent such eventuality from ever happening, the maximum outwardly lateral distance between the two bars, at any and all locations lengthwise, needs only be automatically limited by means fully independent of the operator's control. This is the role of loop 46. Assuming that the bars are moved up and down and are made to reach a composite inclination which prompts the wheel to move toward the small ends of the bars (FIG. 2), as the wheel advances, points A and B tend to move farther apart and the operator must overcome that trend by bringing handles 30 and 32 together. If he succeeds in keeping the wheel halfway between the bars, the wheel will reach the small ends of the bars. Controlling the wheel position becomes more and more difficult as the wheel gets farther and farther from the handles, and it becomes soon impossible for the operator to squeeze the wheel between the bars to slow it down or to straighten it out. At this juncture, the operator has three options: (1) he can prompt the wheel to move very slowly, vertically lifting and lowering one bar at a time if necessary, (2) rotating one or both bars in a direction such that the friction between the bar and shaft surfaces nudges the wheel sideways, and (3) use the fact that the wheel turns toward the shaft that is supported the closest to its free end, so that he may attempt to steer it by lateral movement of the handles. Various combinations of these three basic options are most likely to be used. Other additional options are available to an experienced operator, such as: (1) jerking one or both bars sideways so as to use the wheel inertia laterally to jocket it back in place, and (2) lift one bar, lower the other and concurrently make them come closer to one another, and force the wheel to slide sideways. It is apparent that, even in the case of the simplest apparatus configuration, the control of the wheel motion demands a considerable amount of manual skill and dexterity from the operator.

Three simple ways to increase the degree of difficulty already discussed are to modify the external surfaces of the bars and/or their behaviors. This can be done by: (1) giving a slight bowing shape to the centerlines of the bars of FIG. 3, (2) varying the cross-sections of the bars lengthwise so as to give them the appearance shown in FIG. 4, and (3) off-centering the location of trunnions 48 and 50, so that rotating the bars affects their separation distances. Again, combinations thereof are also simple to implement. Finally, the supports of the small ends of the bars can be modified so that a rotation of the small end generates concurrent lateral and/or vertical displacements thereof. In all of the above discussion, the surfaces of both the bars and the shafts have the same type of finish and friction coefficient throughout these surfaces. This can also be simply changed by coating certain areas of these surfaces, such as S and S' of FIG. 3, with materials that can either increase or decrease the "normal" friction coefficient. The locations of such areas can vary lengthwise and/or around the cross-section. These locations and orientations may differ from one bar to the other, or from one shaft to the other, or both.

In all of the above discussion, the shapes of the shafts and their mountings on the wheel were the same for both. Also, it was implicitly assumed that the shafts and the wheel rotated as one single body, allowing angular motion feedback between the shafts through the wheel. The following discussion pertains to the effects that changes to the shafts have on the wheel assembly behavior and its control. A list of such possible changes is presented below for easier comprehension. Each change can be made to affect only one shaft at a time, and any and all compatible combinations thereof can be used with any other combinations of bars and shaft surfaces which have already been discussed:

1. The shaft is mounted on an axle inserted into the wheel;
2. the shaft may rotate freely around the axle;
3. the shaft is fixed with respect to the axle;
4. both axles are concentrically mounted on the wheel;
5. neither axle is mounted concentrically with the wheel;
6. neither axle is mounted in line with the other;
7. the shaft has an external surface of revolution around the axle and/or the wheel axis;
8. the shaft has an external surface of revolution, but not concentric with the axle;
9. the shaft external surface is not a surface of revolution;
10. the shapes and sizes of the shafts are identical; and
11. the shapes and/or sizes of the shafts are different;

Additional variations can be implemented such as shaft axis not being perpendicular to the plane of symmetry of the wheel, shaft external surface axis and axle not being parallel, etc. . . , but it seems that the number of possible combinations is much too large to warrant further discussing herein. The list above is given so as to show how the degrees of difficulty presented by the apparatus and of skill required of the operator can be varied very gradually over an extremely wide range.

The third component that can be used very simply to alter its own behavior is the wheel itself. It must of course have holes such as 63 and 67 (FIGS. 12 and 17) to hold the axle shanks if the shafts are not made part of the wheel. In addition it may also have holes distributed about its faces such as 73 in which removable and adjustable weights such as 75 can be inserted so as to move the wheel assembly CG away from its axis of rotation and create an unbalance of the wheel. Such unbalance affects the dynamic response of the wheel and increases the level of difficulty. The faces of the wheel come in contact with the bars, either by accident or intentionally on the part of the operator. When this happens, a certain amount of friction develops between the surfaces of the bar and of the wheel face. This effect can either be exploited by the operator as a means of control or become another source of difficulty for him. All or portions of either one or both faces can be coated with a substance which either increases or decreases the friction coefficient of the coated surface. Shaded portions F and F' shown in FIG. 2 illustrate this. Surface F could have a low coefficient of friction, for example, whereas surface F' could exhibit a high friction coefficient.

Finally, because the wheel has two faces and because both faces may not be identical, as above mentioned, the wheel assembly may be positioned on the bars in two ways, 180° apart, each way providing either a different degree of difficulty or means of control. The length of the waves (swelling and shrinking) exhibited by the external surface of the bar of FIG. 4 may be different for each bar, which changes not only the bar-shaft interactions but also the bar-wheel interactions, if the wheel faces have various angular portions coated with different substances. Also, because two bars are used, one of the bar may be reversed so that the handles are mounted as follows: one on the large end of one bar, the other on the small end of the other bar. Looking at the configuration of FIG. 3, with such a reversal in mind, reveals two very significant items: (1) the distance d between the two inwardly directed line contours becomes constant, if the bars are as far apart as possible, line L becoming line L'; and (2) when both bar centerlines are horizontal, the top of one bar rises as the other drops. If the shapes of the shafts were elongated cylinders of revolution, this would mean that the wheel assembly CG would not vertically move, as the shafts roll onto the tops of both bars. However, the wheel would tilt from one side to the other, as the wheel rides from one end of the bars to the other. But the shafts are not so ideally shaped.

Wheel Riding Analysis

At this juncture, the behavior of the wheel assembly should be further analyzed for the simple case of the configuration of FIGS. 1 and 3. This will facilitate the understanding of the wheel response to various solicitations from different sources in the case of more complex apparatus configurations. This simplified analysis is based on the comparison of an idealized reference configuration (elongated cylindrical shafts rolling on straight edges) with the simple configuration of FIGS. 1 and 3. In both cases, the riding motion of the wheel is urged by a gradient $\Delta Z/\Delta Y$ defining the the slope of the path of the wheel CG. By convention, Z is positive downward and Y is positive in the direction pointing away from the handles. X refers to lateral or sideway motions. The tilting response of the wheel is ignored as a first approximation, so is friction. When $\Delta Z/\Delta Y$ is positive, the wheel moves away from the handles. $\Delta Z$ is equal to the sum of the vertical displacements downward of both shaft-bar points of contact. It will be assumed that all displacements are small and that both bars move symmetrically. The available types and directions of motion of each handle are shown and defined in the side diagram of FIG. 3. Wheel 20 changes direction by an angle $\Delta\phi$ around point O (direction of arrow f), if and when the distance D between A and B varies, and distance OB becomes larger than distance OA, for whatever reason, which causes point B to travel a shorter distance than point A. As it does so, distance OB will in turn decrease and OA becomes equal to OB, but overshooting due to momentum causes distance OA to become larger than OB. The configuration of FIG. 3 is theoretically stable, because of the inherent negative feedback thus provided. This effect is therefore neglected provisionally, but for shapes of the shafts such as contour 82 of FIG. 14, in which positive feedback conditions can be induced, it is important and should be remembered.

In FIG. 1, considering only point B, as B moves to b, for whatever reason, the relative positions of shaft 24 and bar crosssection 28 are such that this corresponds to displacements $\Delta X$ and $\Delta Z$ of the wheel, and $\Delta X'$ and $\Delta Z'$ of the bar, assuming that shaft 22 and bar 26 have not moved relatively to each other. It is obvious that $\Delta X$ and $\Delta X'$, and $\Delta Z$ and $\Delta Z'$ are not equal, at least for the subject configuration. In FIG. 1, bar 28 cross-section is shown raised instead of shaft 24 being shown lowered, which assumes that the raising of the bar and its lateral movement are simultaneous. In such case, $\Delta Z$ is smaller than $\Delta Z'$, which means that to maintain the wheel CG in the same position, the bar must be raised at that bar station by an amount larger than the CG drop. The same is assumed to take place with the other shaft.

If point A remains fixed during this process and the operator has lifted bar 28 by the amount $\Delta Z'$, assuming that the wheel was moving forward, point b describes an arc of a circle of diameter D' on shaft 24 surface and which is shorter than the arc of the circle described by point A on the surface of shaft 22. The corresponding distances covered by the contact points on bars 26 and 28 are equal to the length of these two arcs respectively if no slippage is assumed. If the angular rotation of the wheel assembly during the time element considered is $\Omega$, shaft 24 has moved $\Omega(D'-D'')/2$, if D' is shaft 22 diameter at point A station along its length and D'' is shaft 24 diameter at point b station along its length. Again ideally, wheel 20 rotates around a vertical axis passing through point O by the amount $\Delta\phi'$ which is equal to $[\Omega(D'-D'')\int 2]/[D+\Delta X]$ approximately, which causes D'' to increase, D' to decrease, $\Delta X$ to decrease and a new value $\Delta X'$ to come into play (outward displacement of point A on shaft 22, which is almost equal to $\Delta X$, but of opposite sign). Again the system is stable, the end result is the start of a waving-/tilting behavior on the part of the wheel, similar to wobbling. In the assumed model, this action originated only because an initial velocity forward is assumed for the wheel at the moment bar 28 is simultaneously upwardly and outwardly moved by the operator, as earlier mentioned. The velocity at which the wheel was initially moving, its moment of inertia and its mass affect the amplitude of the thus induced waving motion. Gyroscopic effects are deemed negligible and are ignored.-The above means that the operator should always strive to maintain the wheel velocity as low as possible to avoid such sources of additional difficulties.

As earlier mentioned, the operator has several means at his disposal to affect, the correct and even to anticipate the wheel behavior and/or response. He can use those factors which had to be neglected in the above simplified analysis, because of the complexity of their influences. The operator may, as deemed applicable, do the following in the context of the case discussed:

1. rotate both bars by means of the handles in the direction $\omega$, either simultaneously or singularly, to bring the wheel back half way between the bars;
2. move both bars quickly laterally, assuming that their distance has reached its maximum limit, to bring the wheel back half way between the bars, counting on the sideway inertia of the wheel;
3. move bar 28 back toward bar 26;
4. move bar 26 toward bar 28 and, in addition if justified, using the friction between bar 26 and the corresponding face of the wheel, attempt to slow down the wheel, in a braking action;
5. lower both handles by the same amount in an attempt to slow down the forward motion of the wheel, or even stop it, to gain time to think and slowly adjust what seems to him most proper;
6. move bar 26 outwardly, if the bars are not already at their maximum separation distance, in an attempt to establish a wheel position whereby point A is moved closer to point a; and
7. move bars 26 and 28 differentially both laterally and vertically in an attempt to anticipate the wheel immediate next move. The attempts at controlling the wheel motion and velocity listed above are by no means limitative but enumerated only to present a view of the complexity of the control options offered to the operator, even in the simple case discussed above. Several of these options may be combined by an expert operator. The greater the skill and the dexterity of the operator, the larger the number of simultaneous options which the operator might consider, process in his mind and/or carry out. The challenge is further increased by the time element which hinges on quick thinking, fast reflexes and excellent coordination of the movements of both hands.

Without undue elaboration, the added difficulties inherent to each of the structural variations of the basic apparatus embodiment presented in FIGS. 4, 7, 8, 12, 13, 14, 15, and 17 can now be more easily described and discussed. These added difficulties are translated in terms of added degrees of skill and dexterity required on the part of the operator. This is treated altogether in the section below.

Embodiment Variations of the Invention

The bar embodiment of FIG. 4 represents only an enhanced degree of the basic difficulties previously mentioned.Overcoming them demands only a higher degree of the basic skills previously listed. If the wave patterns of both bars are identical, the general wheel behavior and response are those already discussed. The response time available to the operator is cut by a factor of four to five. However,a more stable condition is created each time the shafts reach the bottoms of the waves formed by the bar top generatrices. More time is then made available to think and decide what the best next moves might be. To force the wheel assembly to ride over the bumps (wave swellings), the handles must be lifted higher than is needed in the case of Figure-3 bar configuration. The wheel assembly then accelerates excessively when the gradient reverses itself, past the top of the bump, on the way to a wave bottom. A quick drop of both handles is then required. Also, because of the influence of the shape of the shafts on the degree of feedback caused by the variations of distance A-B on the $\Delta Z/\Delta Y$ of the wheel CG, the magnitude of the difficulty can be greatly amplified.

If the two bars are not identical, but have an unequal number of waves, for instance one bar has two wave bottoms and the other has three, the lateral and vertical movements required of the two handles must be asymmetrical, but still synchronized and coordinated properly. The wheel assembly is then, at some bar stations lengthwise, particularly prompted and enticed to wobble. The wave lengths of the bars and the shapes of the shafts can even be arranged so as to create a dynamic coupling between the wheel assembly motion and the bar wave arrangement, creating a simile resonance. Correcting and/or anticipating such situation requires then the utmost ability on the part of the operator.

To this point, all wheel assemblies discussed had flange and shafts solidly attached, so that the whole assembly could only move as one body, all three components shared a common rotational motion. Another approach is to decouple the three components mechanically by letting each shaft rotate independently from each other and from the wheel (FIGS. 7 and 8). The shafts are laterally restrained by flat surface 90 of the flange in one direction and by locking gland 54 at the end of axle 52, in the other direction. The rotation of the shaft on its axle is free and is facilitated by features intended to lower friction between the two parts, using Teflon coating for instance on the axle and face 90 surfaces. Gland 54 fits loosely in cavity 56 so as to prevent any possible hindrance of that free movement. The shafts can be easily put on or taken off their axles, which permits to change and combine various shaft shapes on one wheel. If the apparatus of FIGS. 1, 2 and 3 is used with such a feature, the wheel behavior and response become quite different from that which was earlier discussed. Shafts 22 and 24 may now rotate at different speeds, the feedback and its influence on the wheel dynamic behavior are eliminated, and the difficulty level is lessened. Lower degrees of skill and dexterity are required to control the wheel motion.

For all configurations in which the shafts are mounted onto axles, multiple degrees of difficulties can again be introduced in the operation of the apparatus. One approach is to mount the axles along axes that are located at equal distance of the wheel axis but in opposite directions (FIGS. 12 and 13), so as to induce wheel wobbling with identical shafts. Another approach is to use shaft axles mounted on a common axis, but equipped with shafts that have a journal 97 (FIG. 7) off-centered with respect to their external identical surfaces. As the shafts roll on identical bars, the wheel is caused to wobble because of the excentricity of the shafts. Such excentricity is impossible to keep in phase (same angular relative position for each shaft) and its effects on the wheel behavior and responses soon become erratic. Still another approach is to depart from a body of revolution for the shaft external shape (FIG. 8). Cross-sections of the shafts shown for different lengthwise stations indicate two contours 41–43 and 95 which can be compared to centered circle 93, and are presented to serve as examples. The first is elliptical, not centered and has two lobes 41 and 43. The second has three lobes and is centered. Axles 52 of both shafts may or may not be in line.Assuming that they are in line and centered on the wheel (Axles 53 and 55 of FIG. 12), the lobes of such uneven contours, also unlikely to stay in phase, will induce erratic wobbling of the wheel. The types and levels of difficulty and control skill can again vary widely.

Another approach to building in and varying difficulty is to equip the wheel with alternate locations for the axles (FIG. 17) around the central location 63. To increase even further the difficulty level, one face of the wheel may have five equidistant holes to mount the axle, the other may have six, so as to multiply the number of possible combinations and to increase the complexity of the wheel response and behavior as it rides.

Finally, the external shapes of the shafts can be used to introduce additional and higher degrees of difficulty. Three basic and typical such shaft contour profiles are depicted in FIG. 14. Profile 80 is similar to those shown in FIGS. 1 and 3, and was previously used to discuss the simplified version of the apparatus. It could be considered as a reference. Profiles 81 and 82 represent two extremes variations of the type of shapes which generates feedback through interactions of shaft and bar shapes. Basically, profile 81 amplifies the influence of the shaft shape profile 80 near the wheel faces and minimizes it in the middle section. Profile 82 is exagerated for ease of illustration, but provides the reversal of feedback sign mentioned earlier. From face 85 (FIG. 14) to point T, the response of the shaft depends upon the size of the cross-section of the bar. If it small, two reversals of feedback sign are provided: First (nearest to face 85), negative feedback; second, no feedback (neck of the shaft); third, positive feedback to point T; fourth, no feedback at point T;and fifth, negative feedback up to the end of the shaft. Positive feedback causes the amplitudes of the wheel wobbling to increase (unstable condition) as the wheel proceeds forward on its ride. The presence of negative feedback, on the contrary, has a stabilizing influence. Of course, two different shaft shapes can can be mounted on the wheel at the same time, one with positive feedback, and the other with negative feedback, both for the full length of the shafts.

In all the combination examples discussed above, the free end of the bars was prevented from moving sideways. This type of full lateral restraint may be altered as shown in FIG. 15, in which the V-shaped recesses are widened to allow the bottom of grooves 34 and 36 to roll a minimal amount. The total amount of rolling outwardly permitted by both grooves cannot exceed the safe limit set by the condition of retention of the wheel assembly between the two bars, if and when one shaft slides off its bar, at any and all lengthwise stations on the bars. On the other hand, there is no reason for limiting such rolling inwardly, as shown by the phantom lines r which depict two linear ramps. For illustration purpose, the wider recesses are given an elliptical convex shape but could have any other shape, again to create feedback between prompted motion of the wheel by the operator and induced motion caused by the built-in response of the apparatus to that wheel motion, at a given relative position of wheel, shafts and bars. Besides rolling in wide recesses, the grooves can also slide in them laterally. This can be urged by the operator by means of the handles, with or without the loop cooperation, for such reasons as: (1) freeing the wheel from a blocked condition (wheel squeezed between both bars), (2) applying the braking action of one or two bars on the wheel, (3) correcting the shaft position on a bar when the wheel comes close to the end of its ride, etc. . . . Many other control uses of such widened recesses with the grooves can be exploited by a skilled and resourceful operator.

Four minor configuration variations of the basic embodiment and of its major configuration variations were earlier mentioned and are:(1) bar centerline bowing, (2) off-centering of the trunnions (which can apply to both ends of the bars), (3) off-centering of some bar cross-sections with respect to its centerline, and (4) off-centering the wheel CG by adding ballast. In the case of the first three variations, again all components of the apparatus must be designed and assembled so that the maximum gap formed by the bars at their maximum separation distance and in the case of the worst combination of bar positions, still satisfies the condition of wheel assembly retention. Also, the angle $\beta-\beta'$ must always be appreciably larger than the maximum variation of inclination angle that the operator may have to impose on either bar, to control the bar riding, for any and all worst combinations of bar profiles, shaft shapes and wheel unbalance, which the operator may encounter, so that a positive gradient $\Delta Z/\Delta Y$ of the wheel CG can easily be obtained at all times.

In the case of ballast addition to the wheel,in general, the end result is that an extra lift of the bars is needed to compensate for the lowering of the CG, at the ballast bottom position, and an extra drop of the handles is needed to compensate for the raising of the CG, at the ballast top position.The wheel assembly behavior resembles that which corresponds to the off-centering of the shafts. However, it must be pointed out that the wheel makes less turns,for a given riding distance on the bars, when the shafts are mounted on axles, or may not even rotate at all, if the friction between the axles and the shafts is not large enough to produce the torque needed to raise the CG from its bottom to its top positions.If this is the case, another type of difficulty is then introduced: wheel chattering in its rotational mode. The vibration so induced will affect the stability of the contacts between the shafts and the bars, and facilitate the sliding of the wheel assembly off the bars in any direction which maximizes the probability of lowering the wheel CG to the lowest position that is most easily attainable. Suffices it to say that the type of difficulty thus created is different from those already mentioned and that the type of skill needed acquires a new character, that of preventing chattering to begin. This can be achieved by minimizing the wheel riding speed and gently shaking the wheel assembly, by means of the bars, so that the wheel is prevented from rotating at all, or only oscillates very little.

In the case of the first three configuration variations listed previously, the added difficulty created by the idiosyncrasy purposely built-in into the bars and/or their trunnion mountings can be transformed into and exploited as an advantage by an experienced operator. As far as the wheel assembly is concerned, it only feels and responds to the positions of points A and B where it is supported, regardless of how it is performed, at least from static considerations. The influence of the wheel dynamic was discussed previously. The relative friction existing at either point of support between the shafts and the bars, at rest, is then of primary importance to the operator, because it is the only means he then has to jockey the wheel into the position he deems best. However, he must constantly be aware of and know the exact consequences that any action on his part will have on the wheel behavior and response. This is a case where a non-reflex action is taken in anticipation of a reaction from the wheel or that is intended to correct a future expected response from the wheel.

The mounting of the shafts on the axles is described in a general form elsewhere above. To provide a quick way to install the shafts or to take them off, and to change the bars, a gland-and-lodging arrangement is used for securing the loop and the shafts in place. FIGS. 7, 9, 10 and 11 illustrate such arrangements. The only difference between the axle and the loop gland workings is in the degree of securing provided. The gland stem (axle 52) of FIG. 7 must fit loosely in journal 97 to minimize friction, but stem 102 and its gland 101 of the loop of FIGS. 10 and 11 should fit tightly into their cooperating female parts in order to lock both halves of the loop. FIG. 9 represents a transversal cross-section of the gland, applicable to either gland 54 or gland 101. In the construction depicted, the gland and its stem are both provided with a bore 104 and longitudinal slots 105 so that bending of the cantilevered portions of the gland-stem assembly is facilitated, so as to permit easy passage of the gland through hole 97 for instance. The stem is made of "springy" material to accommodate such bending without resulting in permanent deformation of the part.

It is impractical to attempt to control the degree of friction between journal 97 and axle 52. In all instances, the fit and surface coatings should be programmed to provide the very minimum of friction. If and when friction needs be increased, this should be done by controllable means so that the degree of friction is reproducible and ascertainable. FIG. 7 indicates how the sliding interaction between axle 52 and journal 97 may be altered by a simile detent system 106 of ball, spring and screw inserted into threaded hole 107. When minimum friction is required, the ball, spring and screw are removed and not needed. When locking of the shaft is desired, the screw compresses the spring to the maximum and forces the ball against one of the slot openings, thereby locking the shaft on its axle. If only a determined amount of friction is needed, the screw is turned to compress the spring by an amount that will yield a degree of drag of the ball on the axle which will simulate the friction desired. Depending upon whether such friction must be constant or applied in sudden larger surges, the location of threaded hole 107 can be moved to a position closer to face 90 upto which the slots do not extend or left where it is located in FIG. 7. Two of such similar arrangements may of course be used.

Summary of the Discussion

The apparatus herein described and discussed, with its many variations, provides a fun toy, means for playing games of skill and improving such skill, means for measuring such skill and improvements thereof, and as a physics teaching tool means for demonstrating examples of body dynamics and feedback theory. The degrees of skill, understanding, teaching and/or dexterity development can be made very gradual between very wide extremes.

The apparatus also has many uses as a training tool for people who must develop movement coordination of either one or both hands. This could apply to various types of professionals whose dexterity and manual skill are vital. It also has applications in the field of rehabilitation of some handicapped persons.

It is thought that the two-bar riding wheel apparatus of the present invention and many of its attendant advantages will be understood from the foregoing description and it will be apparent that various changes may be made in the form, construction and arrangement of the parts thereof without departing from the spirit and scope of the invention or sacrificing any and all of its material advantages, the form hereinbefore described and discussed being merely a preferred examplary embodiment thereof.

Having thus described my invention, I now claim:

1. An apparatus adapted to be operated by the two hands of an operator and comprising:

two quasi circular cross-section bars, each bar being held at one end by one of the operator's hands and supported and partly restrained at the other end by an articulation means;

a fixed support providing said partly restraining articulation means, thereby establishing a fixed set of two reference points for the movements of each bar, in any direction other than axial;

two handles, one located at the free end of each bar and providing the means to the operator for holding the bar free end for generating the bar free end movements;

a circular one-flanged wheel assembly having one cantilevered shaft secured on each face of the flange, the length of the shafts being sufficient to allow the wheel assembly to ride on the bars when situated in a substantially parallel position, one shaft rolling on one bar, the other shaft rolling on the other bar, from one end of the bars to the other end;

means for enabling the operator to adjust the distance between the two bars so as to prevent the wheel assembly from losing the support of either bar;

means for varying the circular cross-sections of the bars from one end of each bar to the other end ;

means for prompting sideway motion of the wheel assembly between the two bars while riding freely on the bars;

means for preventing the wheel assembly from falling between the two bars whenever one shaft falls off its supporting bar;

means for preventing the wheel assembly from moving along and between the two bars in either direction if either shaft becomes unsupported;

means for enabling the disassembly of the wheel assembly and easy changing of either one of the two shafts;

additional shafts having various shaft configurations which, when substituted for either of said two shafts, will alter the characteristics, behavior and response of said wheel assembly to any of the movements of either bar;

means varying the diameter of the circular cross-sections of the bars in a manner such that: (1) the center of gravity of the wheel assembly is always positioned above the line joining the two contact points between the bars and the shafts; and (2) the center of gravity of the wheel assembly is forced to move up and down as the wheel assembly shafts are caused to roll along the bars by the operator's hand movements;

said bar cross-section variations of its quasi diameter being gradual and having both positive and negative gradients along the bar length depending upon the lengthwise location of said bar cross-section; and means for varying the nature and texture of the surfaces of the bars to change their friction coefficients along the length and periphery of the bars, thereby altering the degree of influence that a rotation of either bar cross-section has on affecting the lateral position of the shafts when the wheel assembly rests and rides on the bars at said cross-section location.

2. An apparatus according to claim 1 and further comprising:

means varying the external shape of the shafts in a manner such that the wheel assembly center of gravity is caused to move up and down above the line joining the two contact points between the bars and the shafts as the shafts roll on two flat and level generatrices of the bar external surfaces of quasi revolution;

said variations of the external shape of the shafts being gradual and having both positive and negative gradients along the length and periphery of the shafts depending upon the location of the contact point between the bar and the shaft; and means for varying the nature and texture of the shaft surfaces to change their friction coefficients along the shaft length and periphery, thereby altering the degree of influence that a rotation of either bars has on adjusting the lateral position of the wheel assembly between the two bars.

3. An apparatus according to claim 2 wherein the wheel assembly is positionable on the bars in a manner such that the wheel assembly becomes rotatable in an angular direction selected out of the two possible angular directions when rolling on the bars in a set direction substantially parallel to the bar centerlines, according to the manner in which the wheel assembly is initially positioned on the bars.

4. An apparatus according to claim 2 wherein the shafts rotate on axles attached to and projecting from both faces of the flange, said axles being positioned on a common axis.

5. An apparatus according to claim 2 wherein the shafts rotate on axles attached to and projecting from both faces of the flange, said axles being positioned on different axes.

6. An apparatus according to claim 2 wherein the shafts are solidly affixed to the flange.

7. An apparatus according to claim 1 wherein the bars have indicia shown on their surfaces in a manner such that the location where one shaft falls off its bar and the wheel assembly comes to rest is easily and undisputably identifiable and recordable by any observer present, after the wheel assembly is left askance with one face laying on one bar.

8. An apparatus according to claim 7 wherein the two faces of the wheel assembly flanges have surfaces exhibiting high friction coefficients so as to:

(1) prevent the wheel assembly from easily sliding along the bars when it lays askance on one bar; and (2) affect the rolling of the wheel assembly when one face of the flange comes in contact with either bar surface.

9. An apparatus according to claim 1 wherein both ends of the bars are equipped with a handle and an anchoring groove, thereby enabling the wheel assembly to ride the bars away from the operator, for one orientation of the bars, and toward the operator when the other ends of the bars are anchored onto the fixed support, whereby additional degrees of difficulty and skill required to overcome such difficulty are easily introduced.

10. An apparatus according to claim 1 wherein the articulated restrained end of the bar is prevented from moving laterally in addition to axially by its fixed support.

11. An apparatus according to claim 1 wherein the axis of rotation of the articulation of the bar restrained end is different from the centerline of the external surface of the bar.

12. An apparatus according to claim 1 wherein the bar articulation means on the fixed support allows the manually operated handles of the bars to move vertically, laterally and rotationally simultaneously and separately, and in any combinations and degrees thereof within limits imposed by a rigid structural loop, according to the movements of the operator's hands, said loop being located at the free ends of the bars between the bar structures and their respective handles and allowing the bar axes to come as close to each other as permitted by the flange when the wheel assembly is riding the bars, and to separate no farther than is necessary and sufficient to prevent the wheel assembly from falling between the bars when separated to the maximum amount allowed by the loop.

13. An apparatus according to claim 12 wherein the motions, and their nature and extent, imposed by the operator's hands on the bar handles provide the operator with the means for:

causing the wheel assembly to move along the bars lengthwise in both directions;

compensating for any physical urge that the wheel assembly may have to move sideways as prompted by the inequal mechanical solicitations which the surfaces of the bars and of the shafts impose on the wheel assembly dynamic behavior; and causing the wheel assembly to reach a location on the bars where the wheel assembly becomes gradually confronted with the highest risk of having one of its shaft losing its bar support, whereby reaching the location on the bars of higher risk becomes a measure of higher skill on the part of the operator.

14. An apparatus according to claim 13 wherein the bar centerline is slightly bowed, thereby enabling the operator to adjust the relative lateral position of the wheel assembly so as to decrease the risk of one of the shafts losing its bar support during the wheel assembly rolling motion.

15. An apparatus according to claim 12 wherein the articulated restrained end of the bar is allowed to roll laterally by a limited amount, said limited amount being such for each bar that the wheel assembly is physically prevented from falling between the bars when both ends of both bars become separated by the maximum possible distance.

16. An apparatus according to claim 12 wherein the rigid loop limiting the separation opening between the bars is provided with means for opening said loop so as to enable the operator to change the pairing mode of the bars.

17. A method of measuring, developing and improving the manual dexterity and skill of an operator by means of a wheel assembly cooperating with two substantially parallel bars having quasi circular cross-sections which gradually increase and decrease along the lengths of the bars, the wheel assembly riding on and between the bars, the bars being restrained axially and supported each at one end of their two ends by a fixed supporting structure, each having a manually rotatable handle at the other end and which is movable simultaneously vertically and horizontally, the wheel assembly having a two-faced flange and two shafts secured thereon, one shaft being located on each flange face and having a shape of quasi revolution, each shaft resting on top of a bar on one single support point, the cross-sections of said bars and of said shafts varying according to their lengthwise locations in a manner such that the riding of the bars by the wheel assembly at the operator prompting is caused to increase in difficulty as the wheel assembly travels from one end of the bars to the other in an effort to travel the full length of the bars, said method comprising the steps of:

placing the wheel assembly in a riding position at one end of the bars and therebetween, where the rolling of the shafts on the bars is the easiest to control for the operator;

holding the two handles, one in each hand, and vertically moving said handles in directions such that the hand motions will cause the wheel assembly shafts to roll on the bar tops toward a location on the bars characterized by a higher risk of one shaft slipping off its bar;

simultaneously, as needed, laterally moving the handles so as to prevent said shaft from slipping off said bar as the wheel assembly is constantly urged to ride further, as a first form of control of the wheel riding by the operator;

concurrently, as deemed required by the operator, rotating either bar handle around its longitudinal axis in a direction such that an incipient slipping off of a shaft will be stopped and then corrected, as a result of the friction existing between the shaft and the bar external surfaces, as a second form of control of the wheel riding by the operator;

concurrently, as deemed useful by the operator, moving the handle positions relative to one another in directions such that an incipient slipping off of a shaft is arrested and corrected, as a third form of control by the operator;

concurrently preventing either face of the flange from contacting the bar surfaces, simultaneously using any of the three modes of control available to the operator;

attempting to bring the wheel assembly to a location on the bars that is as far away as possible from the two bar ends where the wheel assembly originated its travel, and if possible, attempting to bring it as far as feasible from these ends of the bars, using any necessary combination of the three modes of control while steadily prompting the wheel assembly to proceed with its riskier and riskier travel; and detecting and recording the location on the bars where one shaft slipped off a bar top, causing thereby the wheel assembly to stop its travel, whereby a measure of the operator's skill and dexterity becomes obtainable.

18. The method as claimed in claim 17 which comprises the further steps of:

synchronizing the linear hand motions imposed on each one of the two bar handles so as to prompt the wheel assembly to move steadily straightforwardly in the direction of increasing difficulty and risk of a shaft slipping off its bar; and concurrently, coordinating the control motions of the three control modes simultaneously between the two hands.

19. The method as claimed in claim 18 which comprises the further steps of:

using the friction between a face of the flange and the external surface of a bar, when said face and said bar make contact, so as to correct the riding position of the wheel assembly and straighten out its forward motion; and using the friction between the external surfaces of a bar and of a shaft for correcting the riding motion of the wheel assembly and readjusting its position between the bars.

20. A game apparatus, comprising:

a pair of elongate bars each having a generally circular cross-section that gradually increases and decreases in diameter along a longitudinal axis thereof;

means for holding a first end of each of the bars so that the first end can be freely articulated about a corresponding reference point and rotated about its longitudinal axis;

means for supporting a second end of each of the bars for permitting manually induced movement toward and away from each other along a generally horizontal path, for permitting the second ends to be manually moved to articulate the first ends about their corresponding reference points and for permitting the second ends to be manually rotated about their corresponding longitudinal axes;

a wheel; and a pair of shafts, each extending from an opposite side of a central axis of the wheel for rolling on a corresponding one of the bars with the wheel spinning between the bars as a result of manual movement of the second ends of the bars.

21. A game apparatus according to claim 20 wherein the shafts are removable from the wheel and are noncircular in cross-section.

22. A game apparatus according to claim 20 wherein a surface texture of the bars varies along their longitudinal axes.

* * * * *